United States Patent [19]

Tregurtha

[11] 4,273,971

[45] Jun. 16, 1981

[54] ELECTRICAL SWITCH HAVING ROTATABLE AND PIVOTABLE LEVER

[75] Inventor: Steven J. Tregurtha, Accrington, England

[73] Assignee: Lucas Industries Limited, Birmingham, England

[21] Appl. No.: 23,278

[22] Filed: Mar. 23, 1979

[30] Foreign Application Priority Data

Mar. 28, 1978 [GB] United Kingdom ..... 11969/78

[51] Int. Cl.[3] ..... H01H 9/00

[52] U.S. Cl. ..... 200/4; 200/61.27; 200/61.54

[58] Field of Search ..... 200/61.27–61.38, 200/4, 61.54

[56] References Cited

U.S. PATENT DOCUMENTS 4,129,757 12/1978 Cryer ..... 200/4

*Primary Examiner*—S. J. Witkowski
*Assistant Examiner*—Morris Ginsburg
*Attorney, Agent, or Firm*—Holman & Stern

[57] ABSTRACT

An electrical switch wherein a body of the switch supports a rotor. A contact is movable with the rotor relative to first, second and third fixed contacts supported by the body. An operating lever extends from the body transverse to the rotor axis and is coupled to the rotor to transmit rotational movement of the lever about its longitudinal axis to move the rotor about its rotational axis. Annular movement of the lever about the rotor axis is also transmitted to move the rotor about its rotational axis. A first detent defines first, second and third predetermined rotational positions of the lever about the lever longitudinal axis. A second detent defines first and second predetermined angular positions of the lever about the rotor axis. The first, second and third fixed contacts, the spacing between the first, second and third rotated lever positions, and the first and second lever angular positions are so arranged that in the first, second and third lever rotational positions respectively, with the lever in its first angular position, the movable contact is respectively, clear of the fixed contacts, in engagement with the first fixed contact, and in engagement with the first and second fixed contacts. However, in the first, second and third lever rotational positions with the lever in its second angular position, the movable contact is respectively, clear of the fixed contacts, in engagement with the first and second fixed contacts, and in engagement with the first and third fixed contacts.

9 Claims, 3 Drawing Figures

ELECTRICAL SWITCH HAVING ROTATABLE AND PIVOTABLE LEVER

This invention relates to an electrical switch particularly, but not exclusively, for use in a road vehicle, the switch being of the kind having an operating lever movable angularly relative to the body of the switch about a first axis and rotatable about its longitudinal axis to operate contacts of the switch, the movement of the lever about said first axis changing the function performed by the rotational movement of the lever.

In a known form of switch of the kind specified, the body carries three leaf spring contacts which normally engage respective fixed contacts, and the lever carries three cam forms associated with the three leaf spring contacts respectively. With the lever in a first angular position the lever has a first rotated position in which all three leaf spring contacts are flexed away from their fixed contacts, a second rotated position in which a first of said leaf spring contacts is permitted to abut its fixed contact and a third position in which the first and second leaf spring contacts are permitted to abut their fixed contacts. However, the relationship between the cam forms and the contacts is such that the same three rotated positions of the lever relative to the body, with the lever in a second angular position relative to the body give rise respectively, to all three leaf spring contacts spaced from their respective fixed contacts; the first and second leaf spring contacts permitted to abut their fixed contacts; and the first and third leaf spring contacts permitted to abut their respective fixed contacts It is an object of the present invention to provide a switch of the kind specified in which sliding rather than abutting electrical contacts are utilised, sliding contacts affording a self cleaning action not normally found in abutting contact arrangements.

An electrical switch according to the invention includes a body, a rotor mounted in the body for rotation relative thereto about a first axis, a movable electrical contact movable with the rotor, first, second and third fixed electrical contacts supported by the body and engageable slidably by the moving contact in its movement about said first axis, an operating lever extending from the body transverse to said first axis, means coupling said operating lever to said rotor whereby rotation of said lever about its longitudinal axis is transmitted to said rotor to move the rotor about said first axis, said means also coupling the lever to the rotor so that angular movement of the lever about said first axis is transmitted to said rotor to move the rotor about said first axis, first detent means defining first, second and third predetermined rotational positions of the lever about its longitudinal axis, second detent means defining first and second predetermined angular positions of the lever about said first axis, and the arrangement of the first, second and third fixed contacts and the spacing between the first, second and third rotational positions and the first and second angular positions of the lever being such that in the first, second and third rotational positions respectively, with the lever in its first angular position, the movable contact is respectively, clear of the fixed contacts, in engagement with the first fixed contact, and in engagement the first and second fixed contacts, whereas in the first, second and third rotational positions respectively, with the lever in its second angular position, the movable contact is respectively, clear of the fixed contacts, in engagement with the first and second fixed contacts, and in engagement with the first and third fixed contacts.

Preferably the movement of the lever between its first and second angular positions moves the rotor through a distance equal to one half of the distance through which the rotor is moved by rotation of the lever between adjacent rotational positions.

Conveniently the movable contact permanently engages a fourth fixed electrical contact and so acts as a movable bridging contact, bridging the fourth and first fixed contacts, the fourth, first and second fixed contacts, or the fourth, first and third fixed contacts dependent upon the position of the rotor about said first axis.

Desirably the lever is movable relative to the body in the direction of its length to operate further electrical contacts carried by the body.

Preferably the lever is movable relative to the body angularly in a plane at right angles to the plane of angular movement containing said first and second angular positions, to operate additional electrical contacts carried by the body.

One example of the invention is illustrated in the accompanying drawings wherein.

Figure 1:
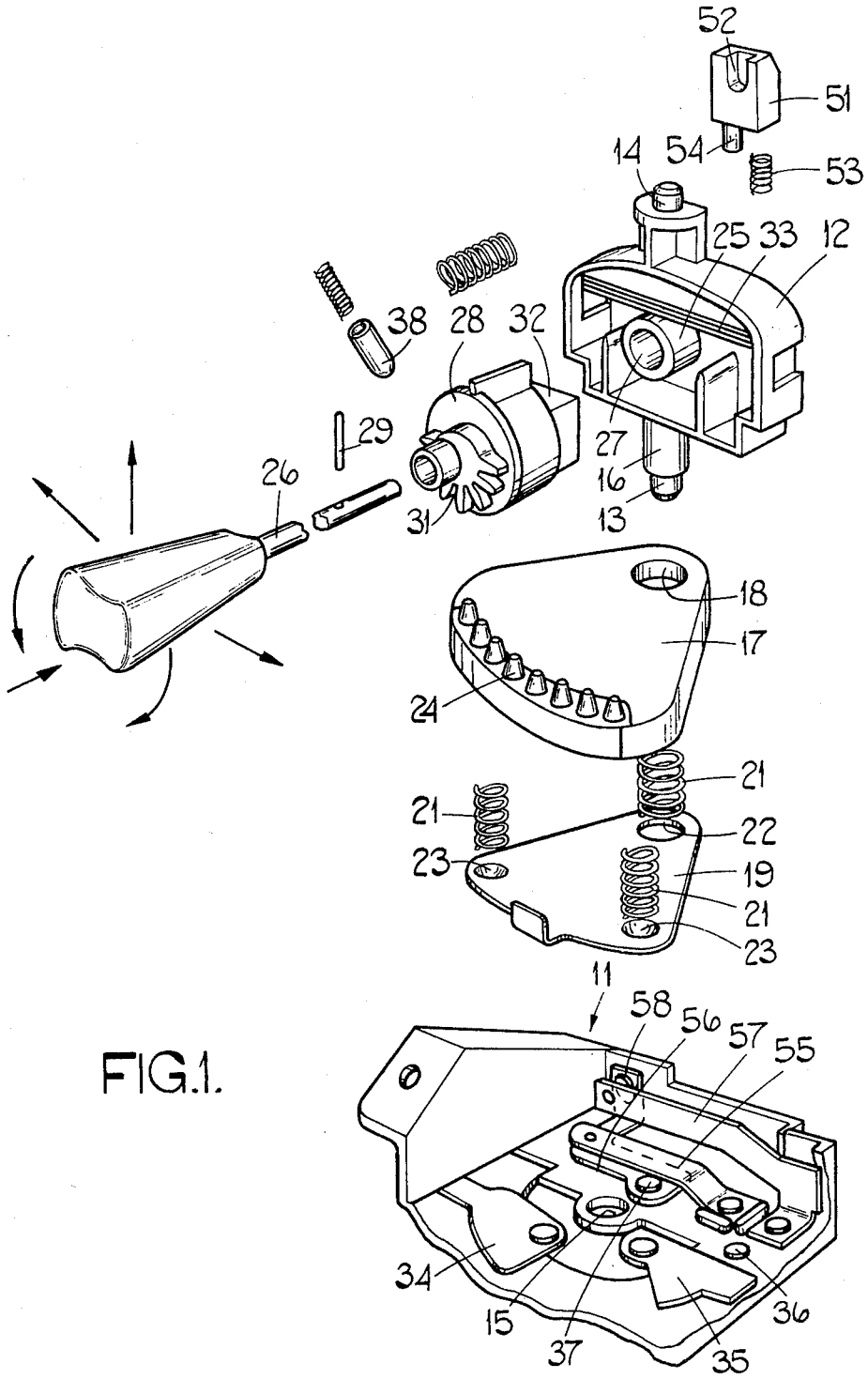
FIG. 1 is an exploded perspective view of an electrical switch.

Referring to the drawings the electrical switch includes a moulded synthetic resin body comprising a base 11 and a cover (not shown) which detachably secures to the base 11 to define a housing. Journalled for rotation in the housing defined by the base 11 and the cover is a moulded synthetic resin pivot member 12 having aligned and oppositely extending integral cylindrical lugs, 13, 14 the lug 13 rotatably engaging in a bore 15 in the base 11 and the lug 14 rotatably engaging in a corresponding bore in the cover so as to support the member 12 for angular movement relative to the housing about the common axis of the lugs 13, 14. The lug 13 is carried at the free end of a short spindle 16 and mounted for angular movement on the spindle 16 and positioned between the member 12 and the base 11 is a moulded synthetic resin rotor 17. The rotor 17 is moulded in synthetic resin material and is of generally triangular form having a bore 18 extending therethrough adjacent an apex of the rotor 17, the spindle 16 extending through the bore 18. Secured to the rotor 17 for angular movement therewith is a triangular brass contact plate 19, the plate 19 being positioned between the rotor 17 and the base 11, and being spring urged towards the base 11 by three compression springs 21 acting between the contact plate 19 and the rotor 17. The contact plate 19 is formed adjacent one apex thereof with a bore 22 corresponding to the bore 18 and through which the spindle 16 extends. Adjacent each of the other two apices of the plate 19, the plate 19 is formed with a hemispherical projection 23 extending towards the base 11. Formed integrally on the face of the rotor 17 remote from the base 11 and extending parallel to the edge thereof remote from the bore 18 is a part circular row of conical teeth 24. The centre of curvature of the circular row of teeth 24 lies on the axis of the bore 18.

Intermediate the lug 14 and the spindle 16 the body of the member 12 is formed integrally with a hollow cylindrical boss 25. The axis of the boss 25 extends generally at right angles to and in the same plane as the axis of the lugs 13, 14. An elongate operating lever 26 is rotatably received in the bore 27 of the boss 25 and extends outwardly from the housing of the switch by way of an aperture in the cover, to define an operating lever on the exterior of the switch.

Within the switch, and between the boss 25 and the cover the lever 26 passes through a moulded synthetic resin drive element 28. A drive pin 29 extends transversely through the lever 26 and couples the lever 26 to the element 28 so that the element 28 rotates with the lever about the longitudinal axis of the lever. The element 28 includes a part circular row of gear teeth 31 the centre of the circular row being on the axis of the lever 26. The pitch of the gear teeth 31 is such that the gear teeth 31 can mesh with the gear teeth 24 on the rotor 17. Moreover at its end remote from the gear teeth 31 the element 28 includes a region 32 of square cross-section engaged by a flat triple spring strip 33 carried by the pivot member 12. During rotation of the element 28 relative to the pivot member 12 the strip 33 is in its least stressed condition when it facially engages a flat of the region 32. However as the element 28 is rotated an apex of the region 32 will cause flexure of the spring 33 and thus the spring 33 and the region 32 of the element 28 define a detent mechanism in turn defining stable rotated positions of the element 28 relative to the member 12, the stable positions of course being disposed at 90° to one another. Although the region 32 has four flat surfaces, and so there are theoretically four stable positions of the element 28 relative to the member 12 an abutment arrangement is provided which limits rotation of the element 28 to 180° and thus there are only in practice three permitted stable positions of the element 28 relative to the member 12 about the axis of the lever 26.

Supported on the base 11 and engageable by the contact plate 19 are four fixed electrical contacts 34, 35, 36 and 37. The contacts 34, 35, are defined by shaped metal plates, and the contacts 36, 37 are defined by metal studs. Each of the contacts is electrically connected to a terminal member on the exterior of the base 11. The contact 37 is permanently engaged by the contact plate 19. Thus the contact plate 19 is in sliding engagement with the contact 37 throughout its range of movement relative to the base 11. Th shaping, and spacing of the contacts 34, 35, 36 in relation to one another and in relation to the plate 19, is such that the plate 19 can occupy first position wherein it engages the contacts 37, 34 and so bridges the contacts 37, 34, a second position wherein it bridges the contacts 37, 34, 35 and a third position wherein it bridges the contacts 37, 34, 36 it being recognised that the plate 19 can only engage the contacts 34, 35, 36 by way of one or other of the two part spherical projections 23. Thus in the position where the plate 19 bridges the contacts 37, 34, 36 it overlies but does not engage the contact 35.

By virtue of the gear connection involving the teeth 24, 31 between the element 28 and the rotor 17, rotation of the lever 26 causes angular movement of the rotor 17 and thus the contact plate 19 about the axis of the spindle 16. However, by virtue of the region 32 of the element 28 and the spring strip 33 there are only three stable positions of the element 28 about the axis of the lever 26 and thus there are equally three stable positions of the rotor 17 and plate 19 as a result of rotation of the lever 26. While the three stable positions of the element 28 are spaced apart by 90° the arrangement of the element 28 and rotor 17 is such that the three stable positions of the rotor 17 and contact plate 19 are spaced apart by 36°.

Since the pivot member 12 is pivotally mounted in the housing of the switch and carries the lever 26 and also therefore the element 28, then it will be recognised that the lever 26 can be moved angularly about the axis of the lugs 13, 14 within the limits which are determined by abutment of the lever with the housing. The arrangement is such that the lever 26 can be moved through an angle of 18° relative to the housing about the axis of the lugs 13, 14. The element 28 of course moves with the lever and thus by virtue of the meshing gear teeth 24, 31 the rotor 17 and contact plate 19 are also moved through the same 18° arc.

A detent arrangement including a spring pressed plunger 38 acting on the element 28 defines two stable positions of the lever 26 in its angular movement about the axis of the lugs 13, 14. The two stable positions are spaced apart by 18°.

Figure 3:
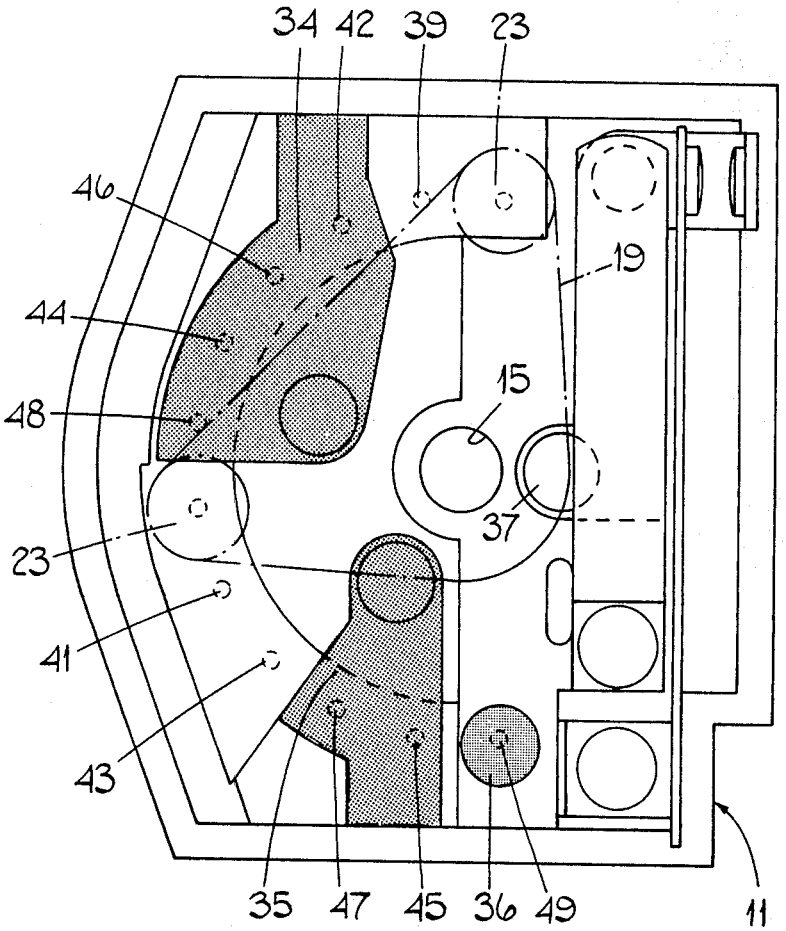
FIG. 3 is a plan view to an enlarged scale of a contact arrangement of the switch shown in FIG. 1.

FIG. 3 illustrates the contact arrangement, and shows the contact plate 19 in broken lines, in its extreme position in a clockwise direction. The projections 23 are illustrated in FIG. 3 and it can be seen that also illustrated in FIG. 3 is an arc of a circle centred on the axis of rotation of the contact plate 19 and passing through the two projections 23. It can be seen that the two projections are spaced apart by 108° around the axis of movement of the contact plate, and a series of reference points on the arc spaced apart by 18° are illustrated. The position of the contact plate 19 shown in FIG. 3 is the position which the contact plate occupies when the lever is in its first angular position, and in its first rotated position. By moving the lever angularly about the axis of the lugs 13, 14 it is clear that the contact plate 19 will be moved through 18° so that the projections 23 will occupy the locations 39, 41 respectively. It can be seen therefore that in both the first and second angular positions of the lever, with the lever in its first rotated position neither of the projections 23 engages a fixed contact, and so no electrical circuits are completed through the switch. However, reverting once again to the first angular position of the lever rotation of the lever from its first to its second rotated position will move the contact plate 19 through 36° and thus the projections 23 will occupy the locations 42 and 42 respectively. Location 42 occurs on the contact 34, and thus in the first angular position of the lever with the lever in its second rotated position the contact plate 19 bridges the contact 37 and the contact 34. Rotation of the lever then to its third rotated position progresses the contact 19 through a further 36° in a counter-clockwise direction so that the projections occupy locations 44 and 45 respectively. Location 44 occurs on the contact 34 and location 45 occurs on the contact 35. Thus with the lever in its first angular position and its third rotated position the contact piece 19 bridges contacts 37, 34 and 35.

Reverting to the first rotated position and second angular position of the lever the projections 23 occupy locations 39 and 41 and so no circuits are made through the switch. Rotation of the lever to its second angular position progresses the contact 19 through 36° so that the projections 23 then correspond to locations 46 and 47. Location 46 is on the contact 34 and location 47 is on the contact 35. Thus in the second angular and second rotated positions of the lever the contact plate 19 bridges contacts 37, 34, 35 and so completes exactly the same circuits as are completed in the first angular and third rotational positions of the lever. Rotation of the lever now to its third rotational position while remaining in its second angular position causes the projections 23 of contact plate 19 to occupy locations 48 and 49, location 48 being on contact 34 and location 49 being on contact 36. Thus with the lever in the second angular position and the third rotated position the contact plate 19 bridges contacts 37, 34, 36 a combination which cannot of course be bridged in any of the rotated positions of the lever while the lever is in its first angular position.

In the interests of completeness it should be recognized that while the lever is in its first rotated position movement of the lever angularly between its first and second angular positions has no effects upon the switch since in both positions no circuits are completed. However, similar movement of the lever angularly with the lever in its second rotated position causes a change in the circuits bridged, from bridging of contacts 37 and 34 in the first angular position to bridging of contacts 37, 34, 35 in the second angular position. Similarly with the lever in its third rotated position movement between the first and second angular positions changes the combination of contacts bridged from bridging of contacts 37, 34 and 35 in the first angular position to bridging of contacts 37, 34, 36 in the second angular position.

Figure 2:
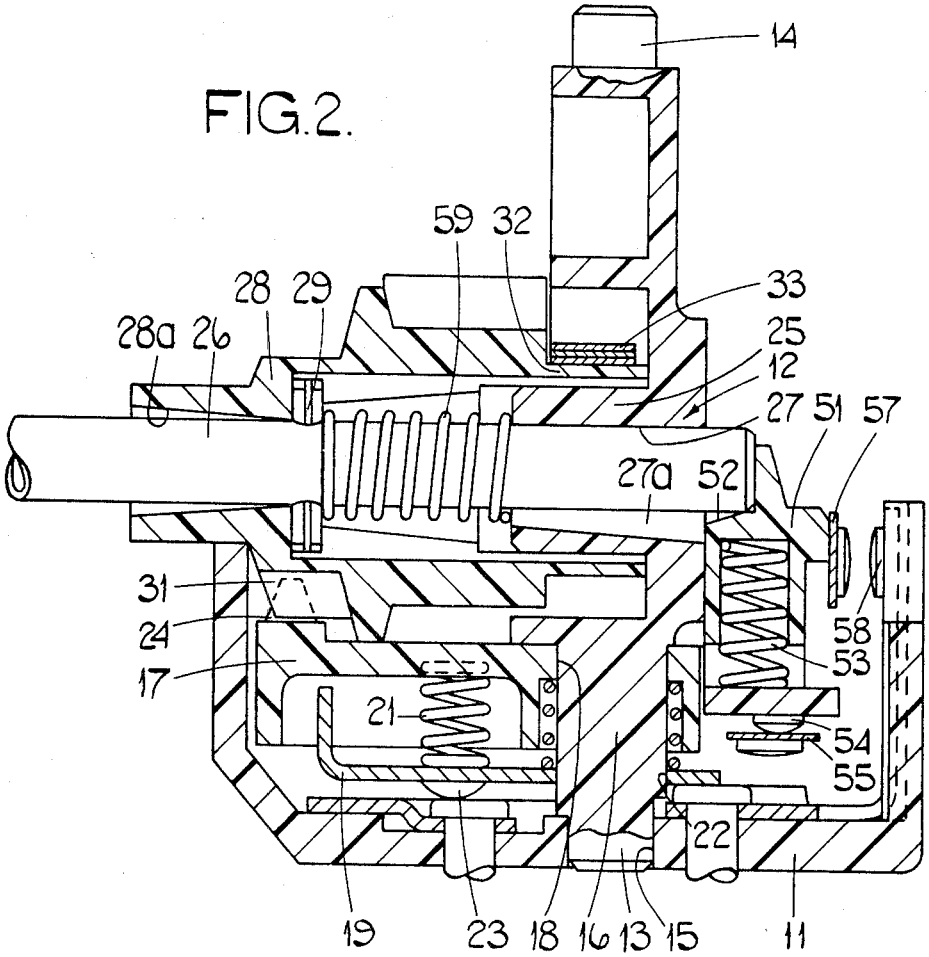
FIG. 2 is a sectional view, to an enlarged scale, of the switch of FIG. 1 assembled.

So far two operational modes of the lever 26 have been discussed the first of these being angular movement of the lever about the axis of the lugs 13, 14 in a plan generally at right angles to that axis, and the second being rotational movement of the lever about its own longitudinal axis. The lever is capable of two further movements, namely longitudinal sliding movement of the lever in the direction of its axis, and angular movement of the lever about an axis generally at right angles to the axis of the lugs 13, 14 and in a plane containing the axis of the lugs 13, 14. The innermost end of the lever 26 projects through the pivot member 12 and engages in a recess 52 of a moulded synthetic resin shoe 51. The shoe 51 is carried by the pivot member 12 during angular movement of the pivot member 12, but can be moved relative thereto against the action of a compression spring 53. Two movements of the shoe 51 relative to the pivot member 12 are possible. The first movement is linear sliding movement in a direction parallel to the axis of the lugs 13, 14, and the second movement is tilting movement relative to the pivot member 12. The bore 27 of the boss 25 is relieved at **27*a* (FIG. 2) and the bore of the element 28 is relieved at 28*a*, both reliefs being to permit movement of the lever 26 angularly in a plane containing the axis of the lugs 13, 14. During such movement the lever 26 pivots about a point generally within the element 28 and thus clockwise pivoting movement (with reference to FIG. 2) will cause the innermost end of the lever 26 to depress the shoe 51 towards the base 11 against the action of the spring 53. A projection 54 on the shoe 51 engages a leaf spring contact 55 carried by the base and as the shoe 51 is moved against the action of the spring 53 the leaf spring contact 55 is flexed to engage a fixed contact 56 on the base. Upon release of the lever 26 the spring 53 restores the lever 26 to a rest position permitting the contact 55 to flex away from the contact 56**.

Longitudinal sliding movement of the lever 26 in the direction of its axis, to depress the lever 26 into the body causes the shoe 51 to be tilted relative to the pivot member 12 and to flex a further leaf spring contact 57 into engagement with a further fixed contact 58 upstanding from the base. A compression spring 59 encircles the lever 26 within the element 28 and acts between the pin 29 and the boss 25 to resist such longitudinal sliding movement. Thus upon release of the lever the combined action of the spring 59, the spring 53 and the leaf spring contact 57 restores the lever 26 to its original rest position wherein the pin 29 abuts an internal shoulder of the element 28.

Longitudinal pulling force exerted inadvertently on the lever 26 is resisted by abutment of the element 28 with the base 11 and cover (not shown).

In one practical embodiment of the switch described above the switch is intended to control operation of the lights and the horn of a road vehicle. The electrical contact 37 is a feed contact electrically connected in use to one pole of the vehicle battery, the other pole of the vehicle battery being earthed. The fixed contact 56 and the fixed contact 58 are both electrically connected to the contact 37, and thus also constitute electrical feed contacts. The contact 34 is in use electrically connected through the side and tail lamps of the vehicle to earth, the fixed contact 35 is electrically connected through the dipped beam filaments of the headlamps of the vehicle to earth, the contact 36 is connected through the main beam filaments of the headlamps to earth, and the contact 57 is electrically connected through the horn of the vehicle to earth. The leaf spring contact 55 is electrically connected to the contact 36 and thus is also electrically connected through the main beam filaments of the headlamps to earth.

In the first angular and first rotational positions of the lever none of the electrical circuits are completed, and so all of the lights and the horn of the vehicle are inoperative. Depression of the lever 26 against the action of the spring 59 causes the contact 57 to engage the contact 58 and thus complete the energising circuit of the horn of the vehicle. The horn thus remains energised until the lever 26 is released whereupon the circuit is again broken.

Movement of the lever 26 from its rest position angularly in the plane containing the axis of the lugs 13, 14 causes the leaf spring contact 55 to engage the fixed contact 56 and thus to complete the energising circuit of the main beam filaments of the headlamps. The main beam filaments remain energised until the lever is released whereupon their circuit is again broken. Thus the movement of the lever 26 angularly in a plane containing the axis of rotation of the member 12 is a headlamp flash facility since the headlamp main beam filaments remain energised only as long as the lever is manually held against the action of the spring 53.

With the lever in its first rotated position, movement of the lever between its first and second angular positions does not complete any of the lighting circuits of the vehicle. However, with the lever in its first angular position rotation of the lever to its second rotated position completes the side and tail lamp circuits of the vehicle. Further rotation to the third rotated position completes the headlamp dipped beam filament circuits in addition to the side and tail lamp circuits.

Rotation of the lever to its second rotated position while in its second angular position completes the side and tail lamp circuits and the headlamp dipped beam filament circuits, and subsequent rotation to the third rotated position breaks the circuit to the headlamp dipped beam filaments and completes the circuits to the headlamp main beam filaments, the side and tail lamp circuits remaining energised.

I claim:

1. An electrical switch including a body, a rotor mounted in the body for rotation relative thereto about a first axis, a movable electrical contact movable with the rotor, first, second and third fixed electrical contacts supported by the body and engageable slidably by the moving contact in its movement about said first axis, an operating lever extending from the body transverse to said first axis, means coupling said operating lever to said rotor whereby rotation of said lever about its longitudinal axis is transmitted to said rotor to move the rotor about said first axis, said means also coupling the lever to the rotor so that angular movement of the lever about said first axis is transmitted to said rotor to move the rotor about said first axis, first detent means defining first, second and third predetermined rotational positions of the lever about its longitudinal axis, second detent means defining first and second predetermined angular positions of the lever about said first axis, and the arrangement of the first, second and third fixed contacts and the spacing between the first, second and third rotational positions and the first and second angular positions of the lever being such that in the first, second and third rotational positions respectively, with the lever in its first angular position, the movable contact is respectively, clear of the fixed contacts, in engagement with the first fixed contact, and in engagement with the first and second fixed contacts, whereas in the first, second and third rotational positions respectively, with the lever in its second angular position, the movable contact is respectively, clear of the fixed contacts, in engagement with the first and second fixed contacts, and in engagement with the first and third fixed contacts.

2. A switch as claimed in claim 1 wherein the movement of the lever between its first and second angular positions moves the rotor through a distance equal to one half of the distance through which the rotor is moved by rotation of the lever between adjacent rotational positions.

3. A switch as claimed in claim 1 or claim 2 wherein the movable contact permanently engages a fourth fixed electrical contact and so acts as a movable bridging contact, bridging the fourth and first fixed contacts, the fourth, first and second fixed contacts, or the fourth, first and third fixed contacts dependent upon the position of the rotor about said first axis.

4. A switch as claimed in claim 1 or claim 2 wherein the lever is movable relative to the body in the direction of its length to operate further electrical contacts carried by the body.

5. A switch as claimed in claim 3 wherein the lever is movable relative to the body in the direction of its length to operate further electrical contacts carried by the body.

6. A switch as claimed in claim 1 or claim 2 wherein the lever is movable relative to the body angularly in a plane at right angles to the plane of angular movement containing said first and second angular positions, to operate additional electrical contacts carried by the body.

7. A switch as claimed in claim 3 wherein the lever is movable relative to the body angularly in a plane at right angles to the plane of angular movement containing said first and second angular positions, to operate additional electrical contacts carried by the body.

8. A switch as claimed in claim 4 wherein the lever is movable relative to the body angularly in a plane at right angles to the plane of angular movement containing said first and second angular positions, to operate additional electrical contacts carried by the body.

9. A switch as claimed in claim 5 wherein the lever is movable relative to the body angularly in a plane at right angles to the plane of angular movement containing said first and second angular positions, to operate additional electrical contacts carried by the body.

* * * * *